United States Patent [19]

Konomi et al.

[11] 4,019,483

[45] Apr. 26, 1977

[54] FUEL SYSTEM FOR MULTICYLINDER ENGINES

[75] Inventors: Toshiaki Konomi; Jyoji Nurita; Takeshi Masuda, all of Susono, Japan

[73] Assignee: Toyota Jidosha Kogyo Kabushiki Kaisha, Japan

[22] Filed: July 15, 1974

[21] Appl. No.: 488,278

[30] Foreign Application Priority Data

Nov. 7, 1973 Japan ..... 48-124475

[52] U.S. Cl. ..... 123/141; 48/180 R

[51] Int. Cl.[2] ..... F02M 29/00

[58] Field of Search ..... 123/141, 119 E; 48/180 R, 180 M

[56] References Cited

UNITED STATES PATENTS

| | | | |
|---|---|---|---|
| 1,526,963 | 2/1923 | Chandler | 48/180 M |
| 1,632,196 | 6/1927 | Rhoads | 123/141 |
| 2,498,190 | 2/1950 | Weeks | 48/180 R |
| 2,769,698 | 11/1956 | Paul | 48/180 R |
| 2,822,253 | 2/1958 | Caddock | 123/141 X |
| 2,847,289 | 8/1958 | Buhrmeister | 48/180 R |
| 3,393,984 | 7/1968 | Wisman | 123/141 X |

FOREIGN PATENTS OR APPLICATIONS

| | | | |
|---|---|---|---|
| 741,462 | 2/1933 | France | 123/141 |

*Primary Examiner*—Charles J. Myhre
*Assistant Examiner*—Ira S. Lazarus
*Attorney, Agent, or Firm*—Toren, McGeady and Stanger

[57] ABSTRACT

In a multicylinder internal combustion engine a cylindrical member is located downstream of a carburetor, with the cylindrical member disposed parallel to a vaporizing barrel of the carburetor and arranged downstream of the vaporizing barrel. A deflector plate for changing the stream of a fuel-air mixture is provided at a downstream position of the cylindrical member. Further, a cylindrical member with a deflector plate is disposed in the downstream of the primary vaporizing barrel of a duplex carburetor, and a cylindrical member with a slant port is disposed downstream of the secondary vaporizing barrel.

9 Claims, 25 Drawing Figures

FIG. 1
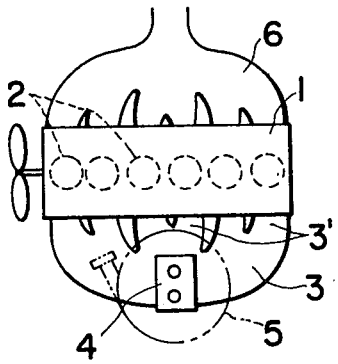
FIG. 2
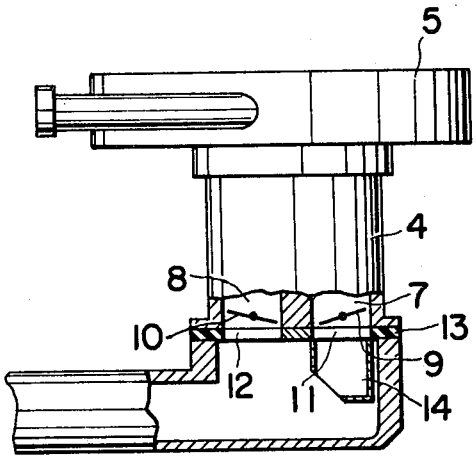
FIG. 3A
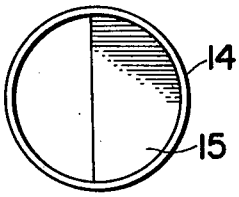
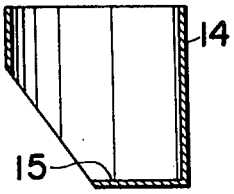
FIG. 3B
FIG. 4
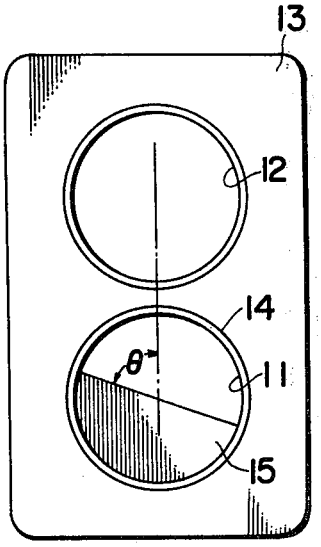

FIG. 5
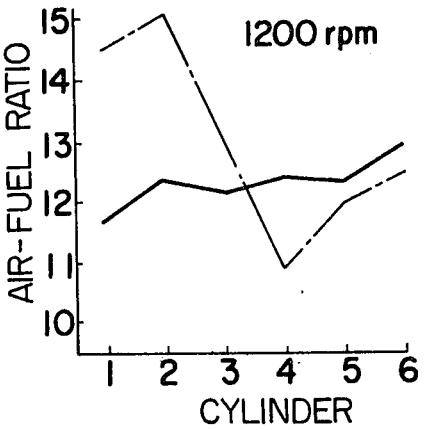
FIG. 6
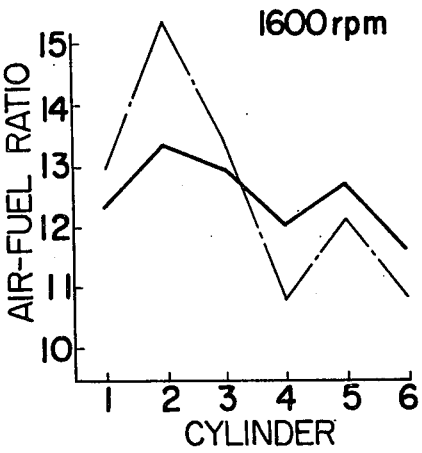
FIG. 7
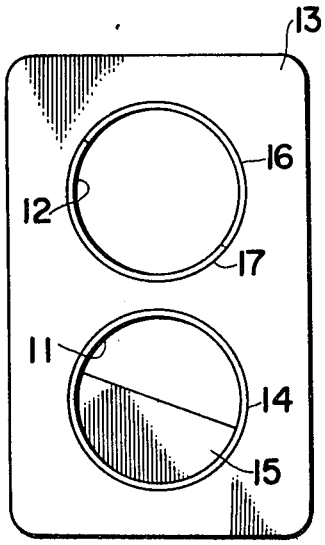
FIG. 8A
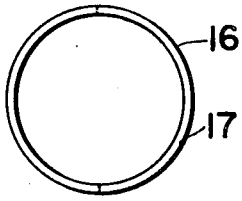
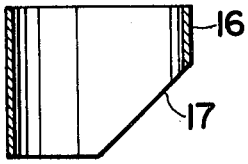
FIG. 8B FIG. 13
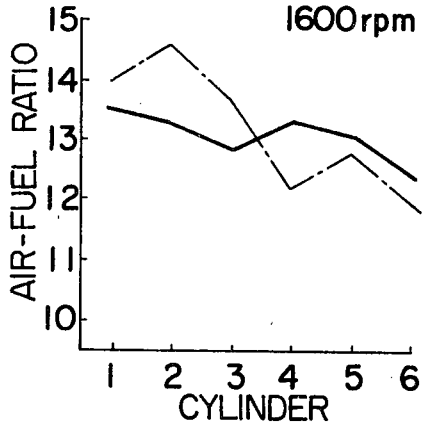
FIG. 14A
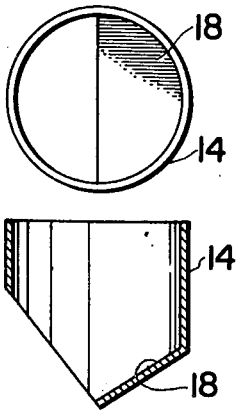
FIG. 14B
FIG. 15A
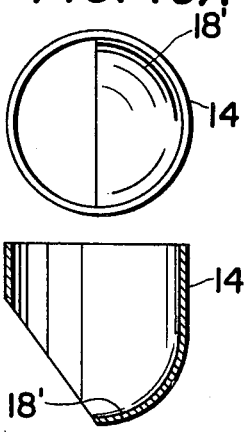
FIG. 15B
FIG. 16A
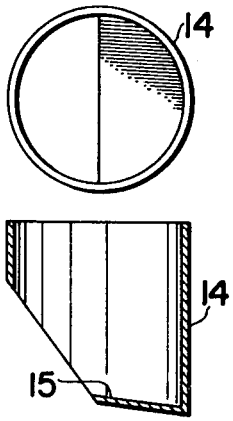
FIG. 16B
FIG. 17A
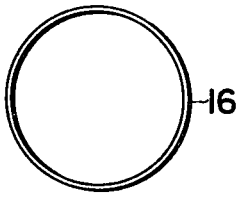
FIG. 17B
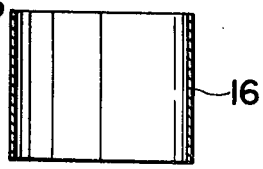
FIG. 18A
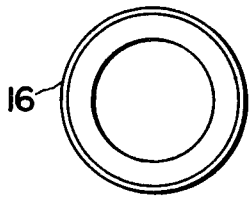
FIG. 18B
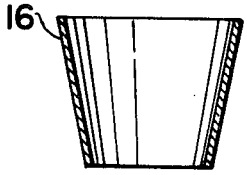

FUEL SYSTEM FOR MULTICYLINDER ENGINES

BACKGROUND OF THE INVENTION

1. Field of the Invention

The present invention relates to a multicylinder internal combustion engine in which a uniform fuel-air mixture is supplied to the respective cylinders from a carburetor.

2. Description of the Prior Art

As a method for improving the distribution of the mixture at full load in a multicylinder internal combustion engine, in the past it has been proposed to change the shape of the intake manifold. However, only using this measure has provided no good result. There has been a method in which the riser portion of a intake manifold is heated and a method in which the intake port of a cylinder is choked, but neither of them produces a beneficial result. Further, although a device has been known in which a moving blade, a fixed blade and a pipe with wire mesh are mounted just under a carburetor for enhancing the atomization of the mixture, it is not very effective for the distribution.

The distribution of the mixture to the different cylinders has its quality determined by the directionality of the stream of the mixture supplied from the carburetor. The directionality of the mixture, in turn, varies in dependence on the number of revolutions of the engine. In particular, in case of a multiple barrel carburetor, the directionality varies at every actuation of each barrel. For this reason, even though the distribution is effective at a certain number of revolutions of the engine, conversely it becomes ineffective when the engine revolves at a different speed.

SUMMARY OF THE INVENTION

Therefore, in order that the directionality of the mixture may be constant even when the number of revolutions of the engine varies, the present invention negates the directionality of the mixture from the carburetor and bestows a horizontal directionality to the mixture. In accordance with the present invention, a multicylinder internal combustion engine is provided in which a cylindrical member is disposed downstream of a throttle valve for the primary barrel of a duplex carburetor, with the cylindrical member being provided with a deflector plate at a part other than the part close to the secondary barrel, and a further cylindrical member is disposed downstream of a throttle valve for the secondary barrel.

BRIEF DESCRIPTION OF THE DRAWINGS

FIG. 1 is a schematic plan view of a multicylinder internal combustion engine according to the present invention;

FIG. 2 is a schematic view, partly in section, of the essential portions of the engine;

FIGS. 3, 8, 14, 15, 16, 17 and 18, A and B, show plan views and sectional side elevations of various cylindrical members;

FIGS. 4, 7 and 11 are plan views of insulators on which the cylindrical members are mounted; and FIGS. 5, 6, 9, 10, 12 and 13 are graphs each illustrating the air-fuel ratios of respective cylinders.

DESCRIPTION OF THE PREFERRED EMBODIMENTS

Figure 9:
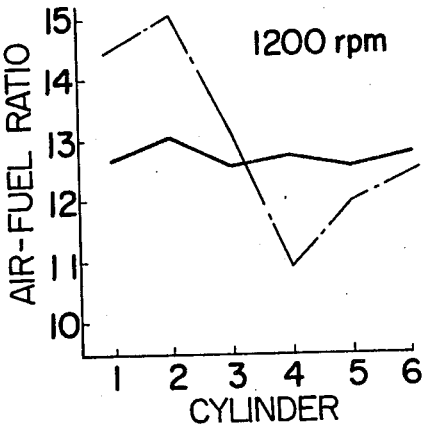

In FIGS. 1 to 4, the present invention is illustrated in reference to a six cylinder internal combustion engine. Six cylinders 2 of an engine are connected via branch pipes 3' of a intake manifold 3, respectively. The intake manifold 3 is connected to a duplex carburetor 4. The duplex carburetor 4 is connected with an air cleaner 5 for supplying fresh air thereto. The respective cylinders 2 of the engine 1 are supplied with a fuel-air mixture by the duplex carburetor 4. After the mixture is burnt in the respective cylinders 2 of the engine 1, the exhaust gas is emitted into the atmospheric air through an exhaust manifold 6. The duplex carburetor 4 is composed of a primary barrel 7 and a secondary barrel 8, which are respectively provided with a throttle valve 9 and a throttle valve 10. When the throttle valve 9 of the primary barrel 7 is opened by a certain opening angle, the throttle valve 10 of the secondary barrel 8 is automatically opened by a device not shown. Between the duplex carburetor 4 and the intake manifold 3, an insulator 13 having two holes 11 and 12 are, respectively, joined to the primary and secondary barrels 7 and 8. In the insulator 13, a cylindrical member 14 is disposed at the hole 11 on the side of the primary barrel 7. The cylindrical member 14 is cut aslant through a diameter of its opening on the downstream side. At the remaining semicircular part of the opening, a deflector plate 15 is mounted. As shown in FIG. 4, the cut end of the cylindrical member 14 is made so that the end edge of the deflector plate 15 may define an angle of approximately 70° with respect to a straight line coupling the centers of the two holes 11 and 12. When the mixture is supplied from the duplex carburetor 4, the directionality of the mixture along the axis of the cylindrical member 14 is once negated and is rendered horizontal by the deflector plate 15 of the cylindrical member 14. The mixture is distributed to the six respective cylinders 2 through the branch pipes 3' of the suction manifold 3.

On the basis of experimental results, description will be made of how the duplex carburetor 4 distributes the mixture to the six cylinders 2 in the internal combustion engine constructed as stated above. FIGS. 5 and 6 represent the air-fuel ratios of the mixture in the respective cylinders 2 in the case where the mixture is supplied to the six cylinders 2 of the engine 1. FIG. 5 corresponds to a case where the engine speed is 1,200 r.p.m., while FIG. 6 corresponds to a case where the speed is 1,600 r.p.m. In the graphs of FIGS. 5 and 6, the ordinate axis indicates the air-fuel ratios, and the abscissa denotes the six cylinders. The full line corresponds to the present invention in which the cylindrical member 14 is disposed, while a one-dot chain line corresponds to the prior art which does not employ the cylindrical member 14.

It is understood from these graphs that the present invention is more uniform in the distribution of the mixture. As compared with the case of 1,200 r.p.m., the case of 1,600 r.p.m. is somewhat inferior in the distribution of the mixture. The reason is that, since the throttle valve 10 of the secondary barrel 8 becomes fully open at 1,600 r.p.m., the distribution is affected by the secondary barrel 8.

The second embodiment will now be explained with reference to FIGS. 7 and 8. In this embodiment, although the cylindrical member 14 mounted at the hole 11 on the side of the primary barrel 7 in the insulator 13 is the same as in the first embodiment, a further cylindrical member 16 is mounted at the hole 12 on the side of the secondary barrel 8. The cylindrical member 16 is cut aslant through a diameter of its opening on the downstream side. The diameter defines an angle of approximately 50° to the straight line coupling the centers of the two holes 11 and 12. The cut end designated at 17 faces the primary barrel 7. In this case, the cylindrical member 16 is provided with no deflector plate.

Figure 10:
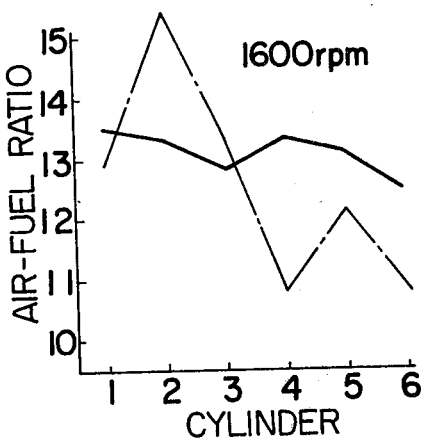

Experimental results of the distributed states of the mixture in the six cylinders in the case of the second embodiment are given in FIGS. 9 and 10. These figures are similar to FIGS. 5 and 6, the full line corresponds to the case of the second embodiment, while the one-dot chain line the case of the prior art. As apparent from these graphs, the distribution of the mixture is improved more than in the first embodiment in which the cylindrical member is disposed only at the hole 11 on the side of the primary barrel 7.

Figure 11:
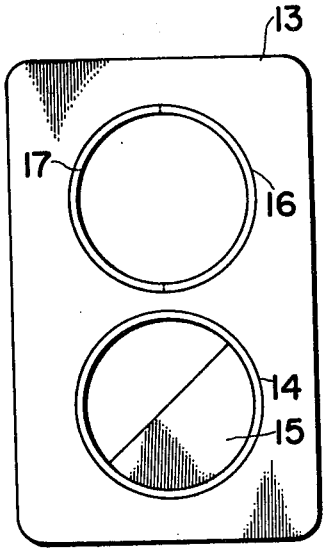

Referring now to FIG. 11, the third embodiment will be described. In this case, although the same cylindrical members as the two cylindrical members 14 and 16 in the second embodiment are used, their senses are changed. More specifically, the cylindrical member 14 disposed in the downstream of the primary barrel 7 is turned by about 115° from the position of that of the second embodiment so that the diametrical edge of the deflector plate 15 of the cylindrical member 14 may define approximately 45° to the straight line coupling the centers of the two holes 11 and 12. On the other hand, the cylindrical member 16 disposed downstream of the secondary barrel 8 is made so that the diameter of the cut opening edge may be in the same direction as the straight line coupling the centers of the two holes 11 and 12.

Figure 12:
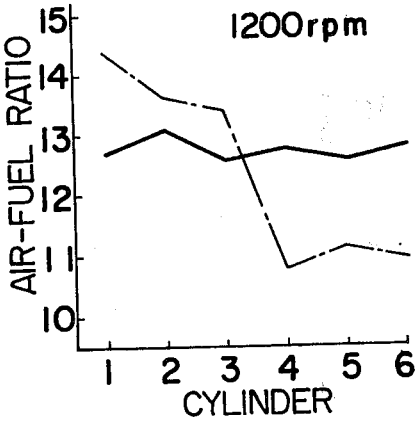

When, in the internal combustion engine thus constructed the duplex carburetor 4 distributes the mixture to the six cylinders 2 through the suction manifold 3, the air-fuel ratios of the respective cylinders become as illustrated in FIGS. 12 and 13 for 1,200 r.p.m. and 1,600 r.p.m. In the two graphs, the full line corresponds to the case of the second embodiment, while a one-dot chain line corresponds to the case of the third embodiment. It is understood from the graphs that the third embodiment is very inferior in the distribution to the second embodiment. In this manner, the senses of the two cylindrical members 14 and 16 exert great influences on the distribution of the mixture.

As apparent from the comparison between the first embodiment and the second embodiment, the cylindrical member 16 disposed in the downstream of the secondary barrel 8 does not affect the distribution of the mixture so greatly as the cylindrical member 14 disposed in the downstream of the primary barrel 14. It is accordingly preferable to attach no deflector plate to the cylindrical member 16 in the downstream of the secondary barrel 8, because the suction resistance at the intake of the mixture to the intake manifold 3 becomes high by the provision of the cylindrical member 16.

Regarding the cylindrical member disposed in the downstream of the primary barrel 7 or the secondary barrel 8, a variety of forms are used. These will be explained as results obtained by experiments.

Instead of the deflector plate 15 provided in the cylindrical member 14, a guide portion 18 shaped into a downwardly inclined plate as shown in FIG. 14 or a guide portion 18′ shaped into a curved surface as shown in FIG. 15 is formed in the cylindrical member 14. In this case, when the mixture flows through the cylindrical member 14, the suction resistance is low, but the directionality of the mixture is somewhat weakened. The distribution of the mixture to the respective cylinders is consequently degraded. Since, however, the mixture does not accumulate in the guide portion 18 or 18′ in the state of liquid, the response is improved in the internal combustion engine, surging and stumbles at low temperatures are obviated, and low temperature starting is enhanced.

The deflector plate 15′ in the cylindrical member 14 is upwardly inclined as shown in FIG. 16. This measure is employed in an engine whose low temperature starting is good. Liquid fuel accumulating on the deflector plate 15′ is blown off by the stream of air, and atomization is promoted. As the result, the uniformity of the fuel-air mixture becomes better, and the output of the engine increases.

The member 16′ is made cylindrical as shown in FIGS. 17A and 17B, or member 16 is conical tapering towards the downstream side as shown in FIGS. 18A and 18B. The cylindrical member 16′ may be disposed in the downstream of the secondary barrel 8 so as to determine the directionality of the mixture. In this case, the distribution of the mixture becomes better, but the output of the engine lowers to some extent since the cylindrical member 16′ adds to the suction resistance. By making the cylindrical member 16′ short, however, the output lowering of the engine is preventable.

Although, in the foregoing, the cylindrical members 14 and 16 are formed separately from the duplex carburetor 4 or the suction manifold 3, they may be formed integrally with the suction manifold 3 or the duplex carburetor 4.

As stated above, the present invention disposes the cylindrical member with the deflector plate in the downstream of the barrel of the carburetor, whereby the directionality of the fuel-air mixture is altered so as to uniformly supply the mixture to the respective branch pipes of the suction manifold, so that the distribution of the mixture to the respective cylinders of the engine is improved. Accordingly, the output can be increased, the fuel cost can be reduced and the response can be enhanced for all revolutions of the engine. Owing to the good distribution of the mixture to the respective cylinders, even when the fuel-air mixture becomes rare, misfire is not feared, and CO and HC in the exhaust gas can be diminished. Furthermore, the vibrations of the engine decrease, and little noises are generated. Besides, an adjustment conforming to the performance of the engine, for example, the improvement of the low-temperature starting property can be achieved by appropriately selecting the shape of the cylindrical member.

While specific embodiments of the invention have been shown and described in detail to illustrate the application of the inventive principles, it will be understood that the invention may be embodied otherwise without departing from such principles.

We claim:

1. A duplex carburetor system comprising a primary barrel, a secondary barrel disposed on one side of said primary barrel laterally spaced therefrom, each of said primary and secondary barrels including a downstream end, intake manifold means in flow communication with both said downstream ends of said primary and secondary barrels arranged to direct flow from said downstream end of said primary barrel laterally in a direction toward said downstream end of said secondary barrel, a hollow cylindrical member having a first end attached in flow communication with said downstream end of said primary barrel and a second end extending into said intake manifold means, said primary barrel and said cylindrical member each including a central axis and being in general axial alignment with each other, a deflector attached to said cylindrical member adjacent said second end thereof and arranged on a side of said cylindrical member laterally remote from said secondary barrel, said deflector extending transversely to the axis of said cylindrical member and terminating at an edge extending chordally of said cylindrical member and spaced inwardly from the side of said cylindrical member closest to said secondary barrel, with said side of said cylindrical member closest to said secondary barrel being cut along a plane extending obliquely to the axis of said cylindrical member and passing through said edge, said plane also extending through a portion of said cylindrical member located upstream of said edge and forming an opening defined by said edge and said upstream portion of said cylindrical member, said opening facing in the direction of said secondary barrel.

2. A system according to claim 1, wherein said deflector comprises a flat planar configuration.

3. A system according to claim 2, wherein said planar deflector extends perpendicularly to the axis of said cylinder.

4. A system according to claim 2, wherein said flat planar deflector extends at an angle obliquely of the axis of said cylinder sloping from said first end thereof toward said second end thereof.

5. A system according to claim 2, wherein said flat planar deflector extends at an angle obliquely of the axis of said cylinder sloping from said second end thereof toward said first end thereof.

6. A system according to claim 1, wherein said deflector comprises a curved configuration.

7. A system according to claim 1, further including a second hollow cylindrical member having a first end attached in flow communication with said downstream end of said secondary barrel and a second end extending into said intake manifold means.

8. A system according to claim 7, wherein said secondary barrel and said second cylindrical member each include a central axis and are in general axial alignment with each other, said second end of said second cylindrical member being configured to define a slanted opening located in a plane extending obliquely to the axis of said second cylindrical member and facing in a direction toward said primary barrel.

9. A system according to claim 1, further including a hollow conically shaped member having a first wider end attached in flow communication with said downstream end of said secondary barrel and a second narrower end extending into said intake manifold means.

* * * * *